US009768495B2

(12) United States Patent
Standke et al.

(10) Patent No.: US 9,768,495 B2
(45) Date of Patent: Sep. 19, 2017

(54) RESONANT BEZEL ANTENNA

(71) Applicant: QUALCOMM Incorporated, San Diego, CA (US)

(72) Inventors: Randolph Standke, San Diego, CA (US); Allen Minh-Triet Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 22 days.

(21) Appl. No.: 14/962,860

(22) Filed: Dec. 8, 2015

(65) Prior Publication Data

US 2016/0308272 A1 Oct. 20, 2016

Related U.S. Application Data

(60) Provisional application No. 62/148,714, filed on Apr. 16, 2015.

(51) Int. Cl.

| | |
|---|---|
| ***H01Q 1/27*** | (2006.01) |
| ***G04G 21/04*** | (2013.01) |
| ***H01Q 1/24*** | (2006.01) |
| ***H01Q 9/14*** | (2006.01) |
| ***H01Q 13/10*** | (2006.01) |
| ***G04R 60/06*** | (2013.01) |

(52) U.S. Cl.

CPC ..... *H01Q 1/273* (2013.01); *G04G 21/04* (2013.01); *G04R 60/06* (2013.01); *H01Q 1/243* (2013.01); *H01Q 9/145* (2013.01); *H01Q 13/10* (2013.01)

(58) Field of Classification Search

CPC ..... H01Q 1/27; H01Q 1/273; H01Q 1/243; H01Q 9/145; H01Q 13/10

See application file for complete search history.

(56) References Cited

U.S. PATENT DOCUMENTS 7,551,142 B1 6/2009 Zhang et al.
7,612,725 B2 11/2009 Hill et al.
(Continued)

FOREIGN PATENT DOCUMENTS

EP 2528165 A1 11/2012
EP 2858172 A1 4/2015

OTHER PUBLICATIONS

International Search Report and Written Opinion—PCT/US2016/022500—ISA/EPO—Jun. 2, 2016.

*Primary Examiner* — Hoang Nguyen

(74) *Attorney, Agent, or Firm* — Arent Fox LLP

(57) ABSTRACT

In an aspect of the disclosure, a method and an apparatus are provided. The apparatus may be a wearable communication apparatus for wireless communication. The wearable communication apparatus includes communication circuitry, a bezel, and a base. The bezel and the base are conductive. The bezel and the base form at least a part of a housing structure supporting the communication circuitry. The base is electrically connected to the bezel. The communication circuitry is electrically connected to the bezel. The bezel is configured to function as a part of a slot antenna. The communication circuitry is configured to send a first communication signal to the bezel such that the bezel transmits the first communication signal over the air. The bezel is further configured to receive, over the air, a second communication signal and direct the second communication signal to the communication circuitry.

30 Claims, 15 Drawing Sheets

(56) References Cited

U.S. PATENT DOCUMENTS

| | | | | |
|---|---|---|---|---|
| 8,270,914 | B2 | 9/2012 | Pascolini et al. | |
| 8,749,438 | B2 | 6/2014 | Jenwatanavet et al. | |
| 9,024,823 | B2 * | 5/2015 | Bevelacqua ..... | H01Q 9/42 343/702 |
| 2005/0219955 | A1 | 10/2005 | Xu et al. | |
| 2014/0266920 | A1 | 9/2014 | Tran et al. | |
| 2014/0340576 | A1 | 11/2014 | Kim et al. | |
| 2015/0048979 | A1 | 2/2015 | Asrani et al. | |
| 2015/0188217 | A1 | 7/2015 | Tsai et al. | |

* cited by examiner

200

RESONANT BEZEL ANTENNA

CROSS-REFERENCE TO RELATED APPLICATION(S)

This application claims the benefit of U.S. Provisional Application Ser. No. 62/148,714, entitled "RESONANT BEZEL ANTENNA" and filed on Apr. 16, 2015, which is expressly incorporated by reference herein in its entirety.

BACKGROUND

Field

The present disclosure relates generally to communication systems, and more particularly, to a resonant bezel antenna useable in a wearable communication apparatus such as a smart watch.

Background

Wireless communication systems are widely deployed to provide various telecommunication services such as telephony, video, data, messaging, and broadcasts. Typical wireless communication systems may employ multiple-access technologies capable of supporting communication with multiple users by sharing available system resources (e.g., bandwidth, transmit power). Examples of such multiple-access technologies include code division multiple access (CDMA) systems, time division multiple access (TDMA) systems, frequency division multiple access (FDMA) systems, orthogonal frequency division multiple access (OFDMA) systems, single-carrier frequency division multiple access (SC-FDMA) systems, and time division synchronous code division multiple access (TD-SCDMA) systems.

These multiple access technologies have been adopted in various telecommunication standards to provide a common protocol that enables different wireless devices to communicate on a municipal, national, regional, and even global level. An example telecommunication standard is Long Term Evolution (LTE). LTE is a set of enhancements to the Universal Mobile Telecommunications System (UMTS) mobile standard promulgated by Third Generation Partnership Project (3GPP). LTE is designed to better support mobile broadband Internet access by improving spectral efficiency, lowering costs, improving services, making use of new spectrum, and better integrating with other open standards using OFDMA on the downlink (DL), SC-FDMA on the uplink (UL), and multiple-input multiple-output (MIMO) antenna technology. However, as the demand for mobile broadband access continues to increase, there exists a need for further improvements in LTE technology. Preferably, these improvements should be applicable to other multi-access technologies and the telecommunication standards that employ these technologies.

SUMMARY

In an aspect of the disclosure, a method and an apparatus are provided. The apparatus may be a wearable communication apparatus for wireless communication. The wearable communication apparatus includes communication circuitry, a bezel, and a base. The bezel and the base are conductive. The bezel and the base form at least a part of a housing structure supporting the communication circuitry. The base is electrically connected to the bezel. The communication circuitry is electrically connected to the bezel. The bezel is configured to function as a part of a slot antenna. The communication circuitry is configured to send a first communication signal to the bezel such that the bezel transmits the first communication signal over the air. The bezel is further configured to receive, over the air, a second communication signal and direct the second communication signal to the communication circuitry.

DETAILED DESCRIPTION

Figure 1:
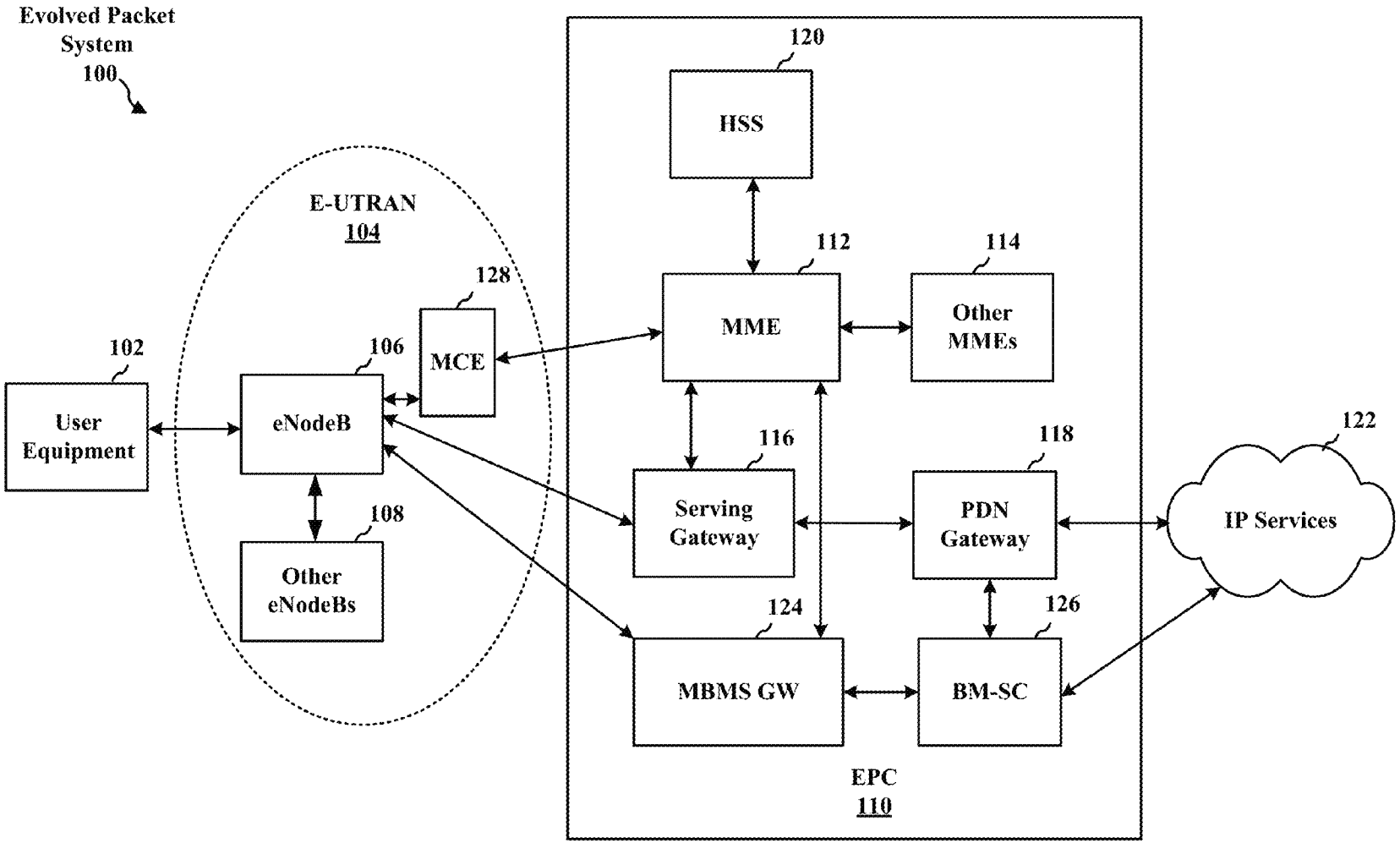
FIG. 1 is a diagram illustrating an example of a network architecture.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Several aspects of telecommunication systems will now be presented with reference to various apparatus and methods. These apparatus and methods will be described in the following detailed description and illustrated in the accompanying drawings by various blocks, components, circuits, steps, processes, algorithms, etc. (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented with a "processing system" that includes one or more processors. Examples of processors include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more exemplary embodiments, the functions described may be implemented in hardware, software, firmware, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), compact disk ROM (CD-ROM) or other optical disk storage, magnetic disk storage or other magnetic storage devices, combinations of the aforementioned types of computer-readable media, or any other medium that can be used to store computer executable code in the form of instructions or data structures that can be accessed by a computer.

FIG. 1 is a diagram illustrating an LTE network architecture 100. The LTE network architecture 100 may be referred to as an Evolved Packet System (EPS) 100. The EPS 100 may include one or more user equipment (UE) 102, an Evolved UMTS Terrestrial Radio Access Network (E-UTRAN) 104, an Evolved Packet Core (EPC) 110, and an Operator's Internet Protocol (IP) Services 122. The EPS can interconnect with other access networks, but for simplicity those entities/interfaces are not shown. As shown, the EPS provides packet-switched services, however, as those skilled in the art will readily appreciate, the various concepts presented throughout this disclosure may be extended to networks providing circuit-switched services.

The E-UTRAN includes the evolved Node B (eNB) 106 and other eNBs 108, and may include a Multicast Coordination Entity (MCE) 128. The eNB 106 provides user and control planes protocol terminations toward the UE 102. The eNB 106 may be connected to the other eNBs 108 via a backhaul (e.g., an X2 interface). The MCE 128 allocates time/frequency radio resources for evolved Multimedia Broadcast Multicast Service (MBMS) (eMBMS), and determines the radio configuration (e.g., a modulation and coding scheme (MCS)) for the eMBMS. The MCE 128 may be a separate entity or part of the eNB 106. The eNB 106 may also be referred to as a base station, a Node B, an access point, a base transceiver station, a radio base station, a radio transceiver, a transceiver function, a basic service set (BSS), an extended service set (ESS), or some other suitable terminology. The eNB 106 provides an access point to the EPC 110 for a UE 102. Examples of UEs 102 include a cellular phone, a smart phone, a session initiation protocol (SIP) phone, a laptop, a personal digital assistant (PDA), a satellite radio, a global positioning system, a multimedia device, a video device, a digital audio player (e.g., MP3 player), a camera, a game console, a tablet, or any other similar functioning device. The UE 102 may also be referred to by those skilled in the art as a mobile station, a subscriber station, a mobile unit, a subscriber unit, a wireless unit, a remote unit, a mobile device, a wireless device, a wireless communications device, a remote device, a mobile subscriber station, an access terminal, a mobile terminal, a wireless terminal, a remote terminal, a handset, a user agent, a mobile client, a client, or some other suitable terminology.

The eNB 106 is connected to the EPC 110. The EPC 110 may include a Mobility Management Entity (MME) 112, a Home Subscriber Server (HSS) 120, other MMES 114, a Serving Gateway 116, a Multimedia Broadcast Multicast Service (MBMS) Gateway 124, a Broadcast Multicast Service Center (BM-SC) 126, and a Packet Data Network (PDN) Gateway 118. The MME 112 is the control node that processes the signaling between the UE 102 and the EPC 110. Generally, the MME 112 provides bearer and connection management. All user IP packets are transferred through the Serving Gateway 116, which itself is connected to the PDN Gateway 118. The PDN Gateway 118 provides UE IP address allocation as well as other functions. The PDN Gateway 118 and the BM-SC 126 are connected to the IP Services 122. The IP Services 122 may include the Internet, an intranet, an IP Multimedia Subsystem (IMS), a PS Streaming Service (PSS), and/or other IP services. The BM-SC 126 may provide functions for MBMS user service provisioning and delivery. The BM-SC 126 may serve as an entry point for content provider MBMS transmission, may be used to authorize and initiate MBMS Bearer Services within a public land mobile network (PLMN), and may be used to schedule and deliver MBMS transmissions. The MBMS Gateway 124 may be used to distribute MBMS traffic to the eNBs (e.g., 106, 108) belonging to a Multicast Broadcast Single Frequency Network (MBSFN) area broadcasting a particular service, and may be responsible for session management (start/stop) and for collecting eMBMS related charging information.

Figure 2:
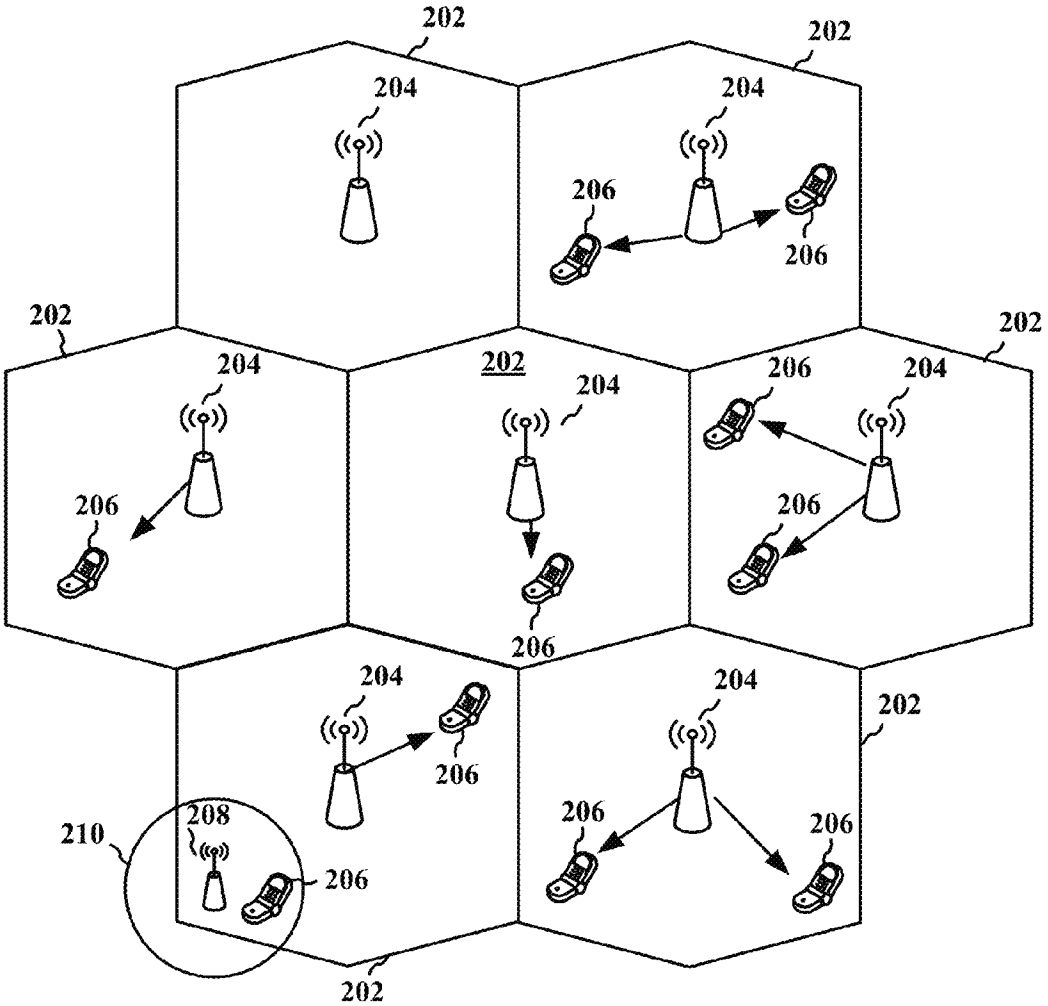
FIG. 2 is a diagram illustrating an example of an access network.

FIG. 2 is a diagram illustrating an example of an access network 200 in an LTE network architecture. In this example, the access network 200 is divided into a number of cellular regions (cells) 202. One or more lower power class eNBs 208 may have cellular regions 210 that overlap with one or more of the cells 202. The lower power class eNB 208 may be a femto cell (e.g., home eNB (HeNB)), pico cell, micro cell, or remote radio head (RRH). The macro eNBs 204 are each assigned to a respective cell 202 and are configured to provide an access point to the EPC 110 for all the UEs 206 in the cells 202. There is no centralized controller in this example of an access network 200, but a centralized controller may be used in alternative configurations. The eNBs 204 are responsible for all radio related functions including radio bearer control, admission control, mobility control, scheduling, security, and connectivity to the serving gateway 116. An eNB may support one or multiple (e.g., three) cells (also referred to as a sectors). The term "cell" can refer to the smallest coverage area of an eNB and/or an eNB subsystem serving a particular coverage area. Further, the terms "eNB," "base station," and "cell" may be used interchangeably herein.

The modulation and multiple access scheme employed by the access network 200 may vary depending on the particular telecommunications standard being deployed. In LTE applications, OFDM is used on the DL and SC-FDMA is used on the UL to support both frequency division duplex (FDD) and time division duplex (TDD). As those skilled in the art will readily appreciate from the detailed description to follow, the various concepts presented herein are well suited for LTE applications. However, these concepts may be readily extended to other telecommunication standards employing other modulation and multiple access techniques. By way of example, these concepts may be extended to Evolution-Data Optimized (EV-DO) or Ultra Mobile Broadband (UMB). EV-DO and UMB are air interface standards promulgated by the 3rd Generation Partnership Project 2 (3GPP2) as part of the CDMA2000 family of standards and employs CDMA to provide broadband Internet access to mobile stations. These concepts may also be extended to Universal Terrestrial Radio Access (UTRA) employing Wideband-CDMA (W-CDMA) and other variants of CDMA, such as TD-SCDMA; Global System for Mobile Communications (GSM) employing TDMA; and Evolved UTRA (E-UTRA), IEEE 802.11 (Wi-Fi), IEEE 802.16 (Wi-MAX), IEEE 802.20, and Flash-OFDM employing OFDMA. UTRA, E-UTRA, UMTS, LTE and GSM are described in documents from the 3GPP organization. CDMA2000 and UMB are described in documents from the 3GPP2 organization. The actual wireless communication standard and the multiple access technology employed will depend on the specific application and the overall design constraints imposed on the system.

The eNBs 204 may have multiple antennas supporting MIMO technology. The use of MIMO technology enables the eNBs 204 to exploit the spatial domain to support spatial multiplexing, beamforming, and transmit diversity. Spatial multiplexing may be used to transmit different streams of data simultaneously on the same frequency. The data streams may be transmitted to a single UE 206 to increase the data rate or to multiple UEs 206 to increase the overall system capacity. This is achieved by spatially precoding each data stream (i.e., applying a scaling of an amplitude and a phase) and then transmitting each spatially precoded stream through multiple transmit antennas on the DL. The spatially precoded data streams arrive at the UE(s) 206 with different spatial signatures, which enables each of the UE(s) 206 to recover the one or more data streams destined for that UE 206. On the UL, each UE 206 transmits a spatially precoded data stream, which enables the eNB 204 to identify the source of each spatially precoded data stream.

Spatial multiplexing is generally used when channel conditions are good. When channel conditions are less favorable, beamforming may be used to focus the transmission energy in one or more directions. This may be achieved by spatially precoding the data for transmission through multiple antennas. To achieve good coverage at the edges of the cell, a single stream beamforming transmission may be used in combination with transmit diversity.

In the detailed description that follows, various aspects of an access network will be described with reference to a MIMO system supporting OFDM on the DL. OFDM is a spread-spectrum technique that modulates data over a number of subcarriers within an OFDM symbol. The subcarriers are spaced apart at precise frequencies. The spacing provides "orthogonality" that enables a receiver to recover the data from the subcarriers. In the time domain, a guard interval (e.g., cyclic prefix) may be added to each OFDM symbol to combat inter-OFDM-symbol interference. The UL may use SC-FDMA in the form of a DFT-spread OFDM signal to compensate for high peak-to-average power ratio (PAPR).

Figure 3:
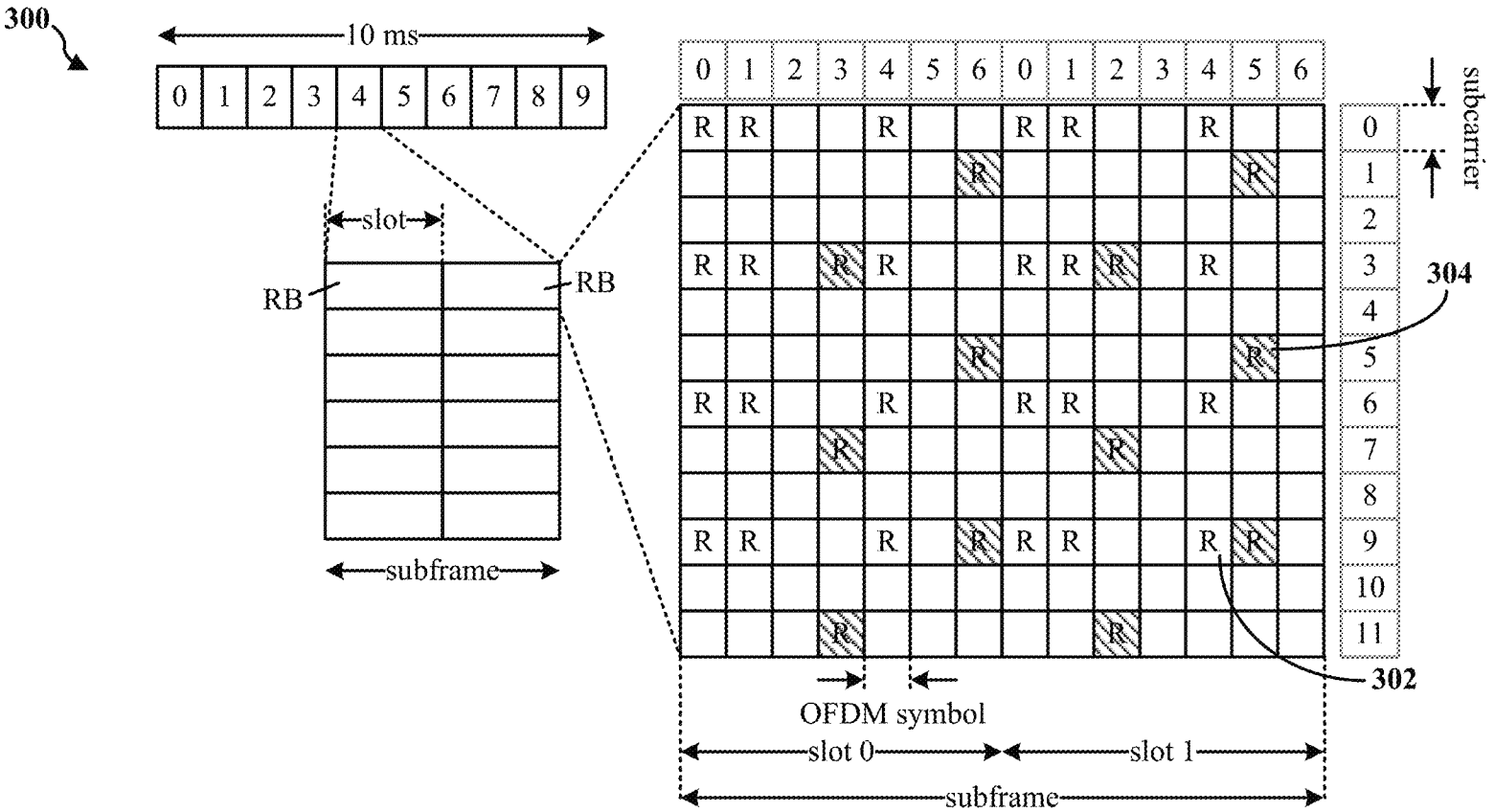
FIG. 3 is a diagram illustrating an example of a DL frame structure in LTE.

FIG. 3 is a diagram 300 illustrating an example of a DL frame structure in LTE. A frame (10 ms) may be divided into 10 equally sized subframes. Each subframe may include two consecutive time slots. A resource grid may be used to represent two time slots, each time slot including a resource block. The resource grid is divided into multiple resource elements. In LTE, for a normal cyclic prefix, a resource block contains 12 consecutive subcarriers in the frequency domain and 7 consecutive OFDM symbols in the time domain, for a total of 84 resource elements. For an extended cyclic prefix, a resource block contains 12 consecutive subcarriers in the frequency domain and 6 consecutive OFDM symbols in the time domain, for a total of 72 resource elements. Some of the resource elements, indicated as R 302, 304, include DL reference signals (DL-RS). The DL-RS include Cell-specific RS (CRS) (also sometimes called common RS) 302 and UE-specific RS (UE-RS) 304. UE-RS 304 are transmitted on the resource blocks upon which the corresponding physical DL shared channel (PDSCH) is mapped. The number of bits carried by each resource element depends on the modulation scheme. Thus, the more resource blocks that a UE receives and the higher the modulation scheme, the higher the data rate for the UE.

Figure 4:
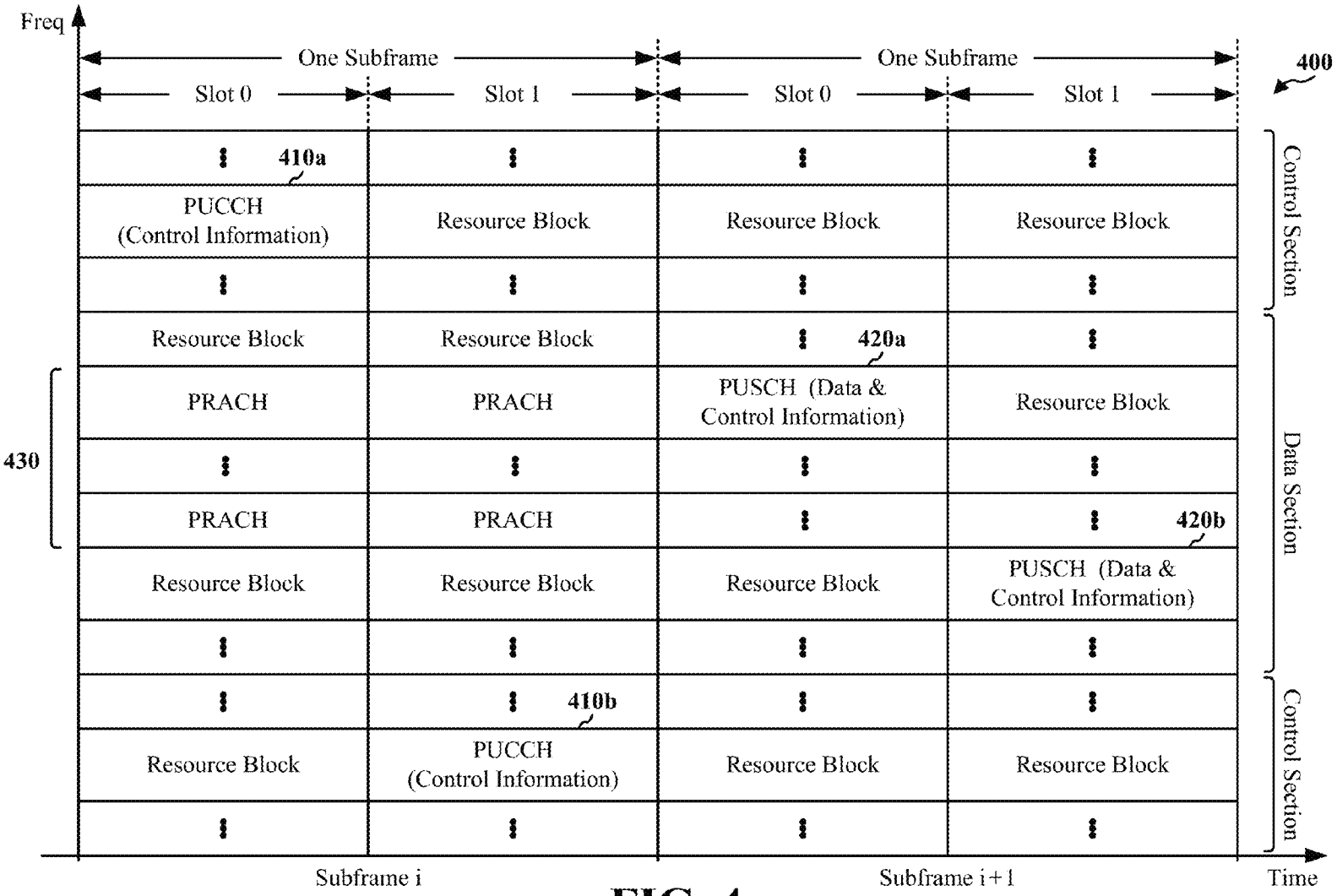
FIG. 4 is a diagram illustrating an example of an UL frame structure in LTE.

FIG. 4 is a diagram 400 illustrating an example of an UL frame structure in LTE. The available resource blocks for the UL may be partitioned into a data section and a control section. The control section may be formed at the two edges of the system bandwidth and may have a configurable size. The resource blocks in the control section may be assigned to UEs for transmission of control information. The data section may include all resource blocks not included in the control section. The UL frame structure results in the data section including contiguous subcarriers, which may allow a single UE to be assigned all of the contiguous subcarriers in the data section.

A UE may be assigned resource blocks 410*a*, 410*b* in the control section to transmit control information to an eNB. The UE may also be assigned resource blocks 420*a*, 420*b* in the data section to transmit data to the eNB. The UE may transmit control information in a physical UL control channel (PUCCH) on the assigned resource blocks in the control section. The UE may transmit data or both data and control information in a physical UL shared channel (PUSCH) on the assigned resource blocks in the data section. A UL transmission may span both slots of a subframe and may hop across frequency.

A set of resource blocks may be used to perform initial system access and achieve UL synchronization in a physical random access channel (PRACH) 430. The PRACH 430 carries a random sequence and cannot carry any UL data/signaling. Each random access preamble occupies a bandwidth corresponding to six consecutive resource blocks. The starting frequency is specified by the network. That is, the transmission of the random access preamble is restricted to certain time and frequency resources. There is no frequency hopping for the PRACH. The PRACH attempt is carried in a single subframe (1 ms) or in a sequence of few contiguous subframes and a UE can make a single PRACH attempt per frame (10 ms).

Figure 5:
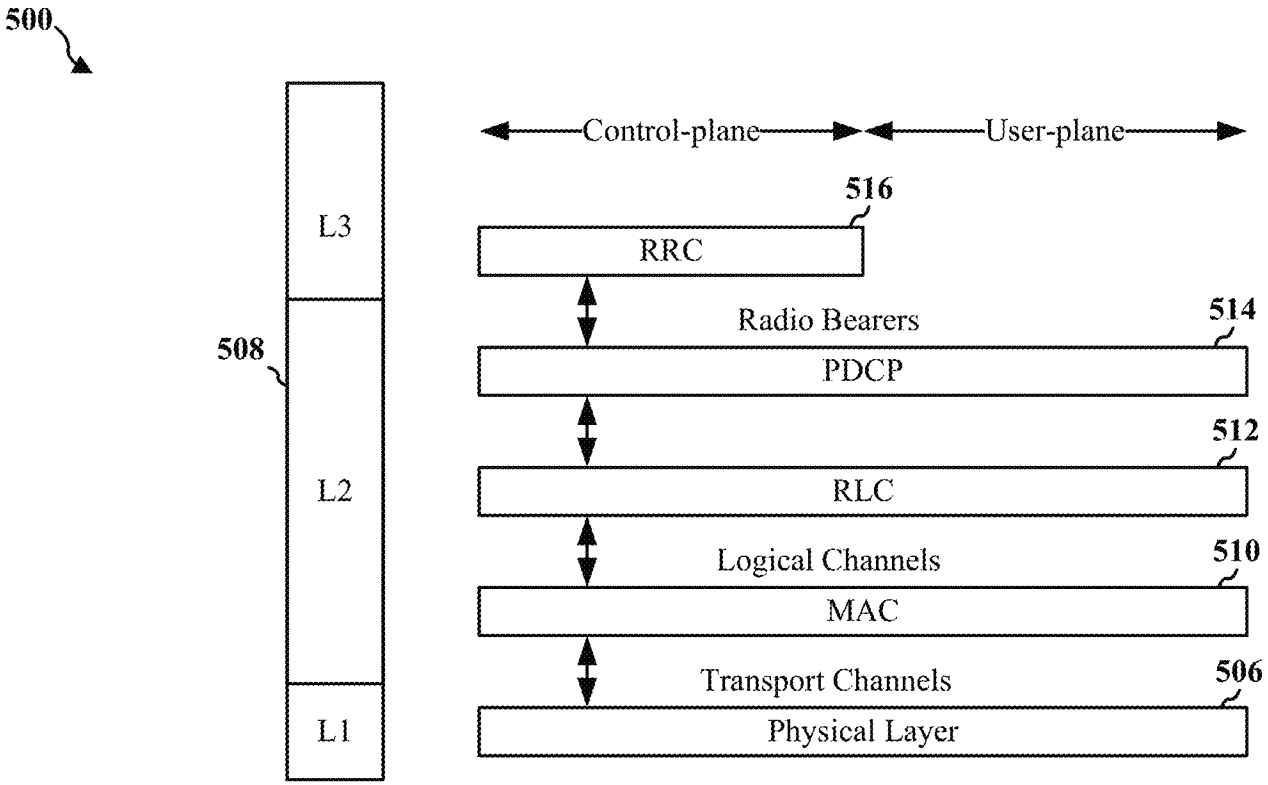
FIG. 5 is a diagram illustrating an example of a radio protocol architecture for the user and control planes.

FIG. 5 is a diagram 500 illustrating an example of a radio protocol architecture for the user and control planes in LTE. The radio protocol architecture for the UE and the eNB is shown with three layers: Layer 1, Layer 2, and Layer 3. Layer 1 (L1 layer) is the lowest layer and implements various physical layer signal processing functions. The L1 layer will be referred to herein as the physical layer 506. Layer 2 (L2 layer) 508 is above the physical layer 506 and is responsible for the link between the UE and eNB over the physical layer 506.

In the user plane, the L2 layer 508 includes a media access control (MAC) sublayer 510, a radio link control (RLC) sublayer 512, and a packet data convergence protocol (PDCP) 514 sublayer, which are terminated at the eNB on the network side. Although not shown, the UE may have several upper layers above the L2 layer 508 including a network layer (e.g., IP layer) that is terminated at the PDN gateway 118 on the network side, and an application layer that is terminated at the other end of the connection (e.g., far end UE, server, etc.).

The PDCP sublayer 514 provides multiplexing between different radio bearers and logical channels. The PDCP sublayer 514 also provides header compression for upper layer data packets to reduce radio transmission overhead, security by ciphering the data packets, and handover support for UEs between eNBs. The RLC sublayer 512 provides segmentation and reassembly of upper layer data packets, retransmission of lost data packets, and reordering of data packets to compensate for out-of-order reception due to hybrid automatic repeat request (HARQ). The MAC sublayer 510 provides multiplexing between logical and transport channels. The MAC sublayer 510 is also responsible for allocating the various radio resources (e.g., resource blocks) in one cell among the UEs. The MAC sublayer 510 is also responsible for HARQ operations.

In the control plane, the radio protocol architecture for the UE and eNB is substantially the same for the physical layer 506 and the L2 layer 508 with the exception that there is no header compression function for the control plane. The control plane also includes a radio resource control (RRC) sublayer 516 in Layer 3 (L3 layer). The RRC sublayer 516 is responsible for obtaining radio resources (e.g., radio bearers) and for configuring the lower layers using RRC signaling between the eNB and the UE.

Figure 6:
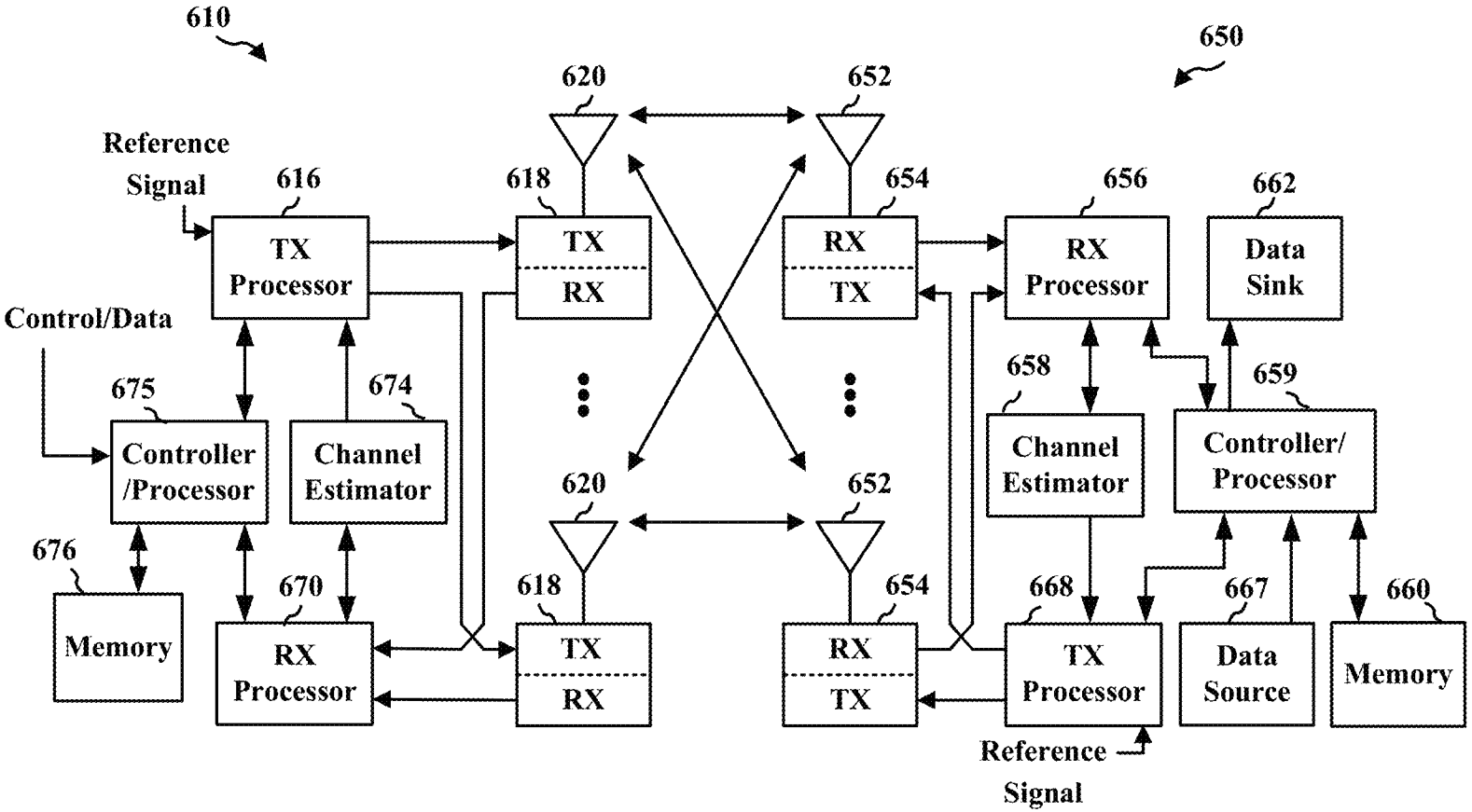
FIG. 6 is a diagram illustrating an example of an evolved Node B and user equipment in an access network.

FIG. 6 is a block diagram of an eNB 610 in communication with a UE 650 in an access network. In the DL, upper layer packets from the core network are provided to a controller/processor 675. The controller/processor 675 implements the functionality of the L2 layer. In the DL, the controller/processor 675 provides header compression, ciphering, packet segmentation and reordering, multiplexing between logical and transport channels, and radio resource allocations to the UE 650 based on various priority metrics. The controller/processor 675 is also responsible for HARQ operations, retransmission of lost packets, and signaling to the UE 650.

The transmit (TX) processor 616 implements various signal processing functions for the L1 layer (i.e., physical layer). The signal processing functions include coding and interleaving to facilitate forward error correction (FEC) at the UE 650 and mapping to signal constellations based on various modulation schemes (e.g., binary phase-shift keying (BPSK), quadrature phase-shift keying (QPSK), M-phase-shift keying (M-PSK), M-quadrature amplitude modulation (M-QAM)). The coded and modulated symbols are then split into parallel streams. Each stream is then mapped to an OFDM subcarrier, multiplexed with a reference signal (e.g., pilot) in the time and/or frequency domain, and then combined together using an Inverse Fast Fourier Transform (IFFT) to produce a physical channel carrying a time domain OFDM symbol stream. The OFDM stream is spatially precoded to produce multiple spatial streams. Channel estimates from a channel estimator 674 may be used to determine the coding and modulation scheme, as well as for spatial processing. The channel estimate may be derived from a reference signal and/or channel condition feedback transmitted by the UE 650. Each spatial stream may then be provided to a different antenna 620 via a separate transmitter 618TX. Each transmitter 618TX may modulate an RF carrier with a respective spatial stream for transmission.

At the UE 650, each receiver 654RX receives a signal through its respective antenna 652. Each receiver 654RX recovers information modulated onto an RF carrier and provides the information to the receive (RX) processor 656. The RX processor 656 implements various signal processing functions of the L1 layer. The RX processor 656 may perform spatial processing on the information to recover any spatial streams destined for the UE 650. If multiple spatial streams are destined for the UE 650, they may be combined by the RX processor 656 into a single OFDM symbol stream. The RX processor 656 then converts the OFDM symbol stream from the time-domain to the frequency domain using a Fast Fourier Transform (FFT). The frequency domain signal comprises a separate OFDM symbol stream for each subcarrier of the OFDM signal. The symbols on each subcarrier, and the reference signal, are recovered and demodulated by determining the most likely signal constellation points transmitted by the eNB 610. These soft decisions may be based on channel estimates computed by the channel estimator 658. The soft decisions are then decoded and deinterleaved to recover the data and control signals that were originally transmitted by the eNB 610 on the physical channel. The data and control signals are then provided to the controller/processor 659.

The controller/processor 659 implements the L2 layer. The controller/processor 659 can be associated with a memory 660 that stores program codes and data. The memory 660 may be referred to as a computer-readable medium. In the UL, the controller/processor 659 provides demultiplexing between transport and logical channels, packet reassembly, deciphering, header decompression, control signal processing to recover upper layer packets from the core network. The upper layer packets are then provided to a data sink 662, which represents all the protocol layers above the L2 layer. Various control signals may also be provided to the data sink 662 for L3 processing. The controller/processor 659 is also responsible for error detection using an acknowledgement (ACK) and/or negative acknowledgement (NACK) protocol to support HARQ operations.

In the UL, a data source 667 is used to provide upper layer packets to the controller/processor 659. The data source 667 represents all protocol layers above the L2 layer. Similar to the functionality described in connection with the DL transmission by the eNB 610, the controller/processor 659 implements the L2 layer for the user plane and the control plane by providing header compression, ciphering, packet segmentation and reordering, and multiplexing between logical and transport channels based on radio resource allocations by the eNB 610. The controller/processor 659 is also responsible for HARQ operations, retransmission of lost packets, and signaling to the eNB 610.

Channel estimates derived by a channel estimator 658 from a reference signal or feedback transmitted by the eNB 610 may be used by the TX processor 668 to select the appropriate coding and modulation schemes, and to facilitate spatial processing. The spatial streams generated by the TX processor 668 may be provided to different antenna 652 via separate transmitters 654TX. Each transmitter 654TX may modulate an RF carrier with a respective spatial stream for transmission.

The UL transmission is processed at the eNB 610 in a manner similar to that described in connection with the receiver function at the UE 650. Each receiver 618RX receives a signal through its respective antenna 620. Each receiver 618RX recovers information modulated onto an RF carrier and provides the information to a RX processor 670. The RX processor 670 may implement the L1 layer.

The controller/processor 675 implements the L2 layer. The controller/processor 675 can be associated with a memory 676 that stores program codes and data. The memory 676 may be referred to as a computer-readable medium. In the UL, the controller/processor 675 provides demultiplexing between transport and logical channels, packet reassembly, deciphering, header decompression, control signal processing to recover upper layer packets from the UE 650. Upper layer packets from the controller/processor 675 may be provided to the core network. The controller/processor 675 is also responsible for error detection using an ACK and/or NACK protocol to support HARQ operations.

Figure 7:
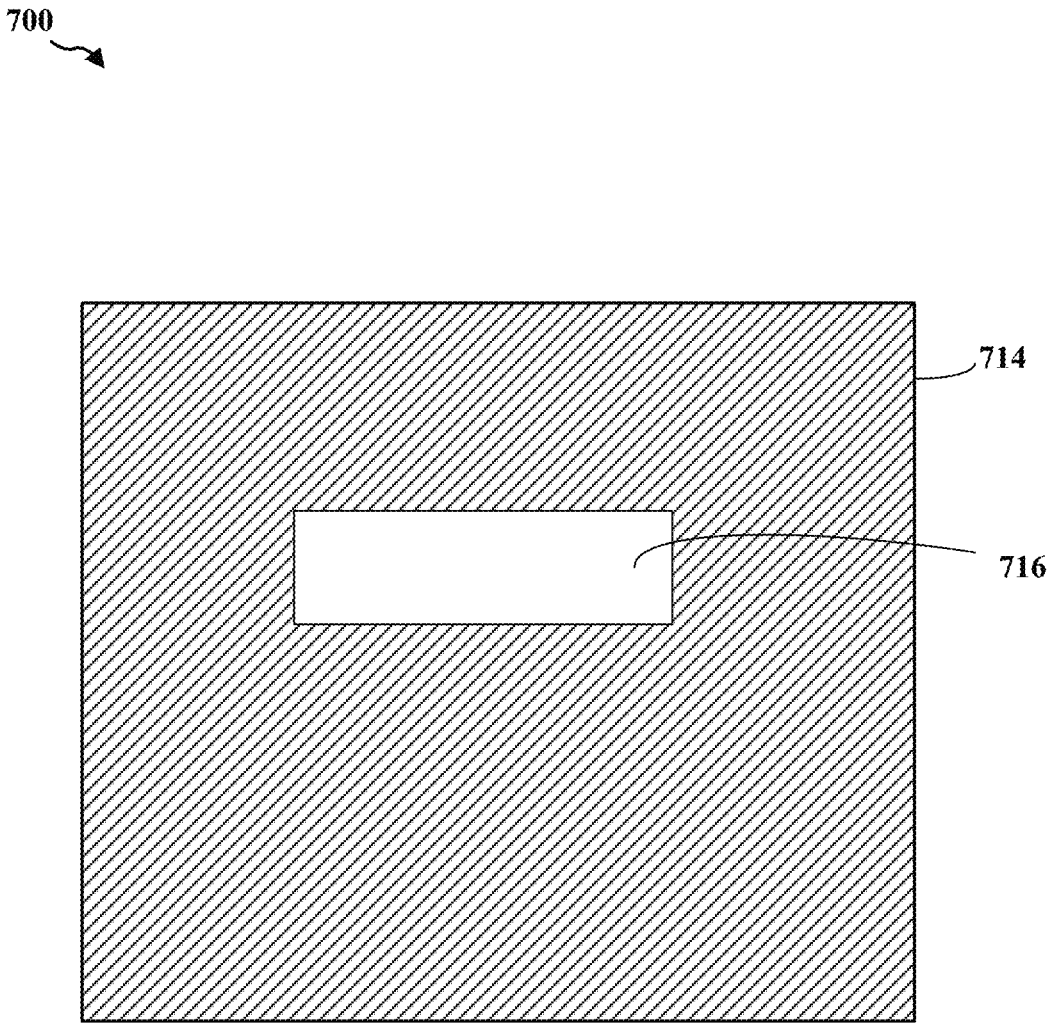
FIG. 7 shows a slot antenna.
Figure 8:
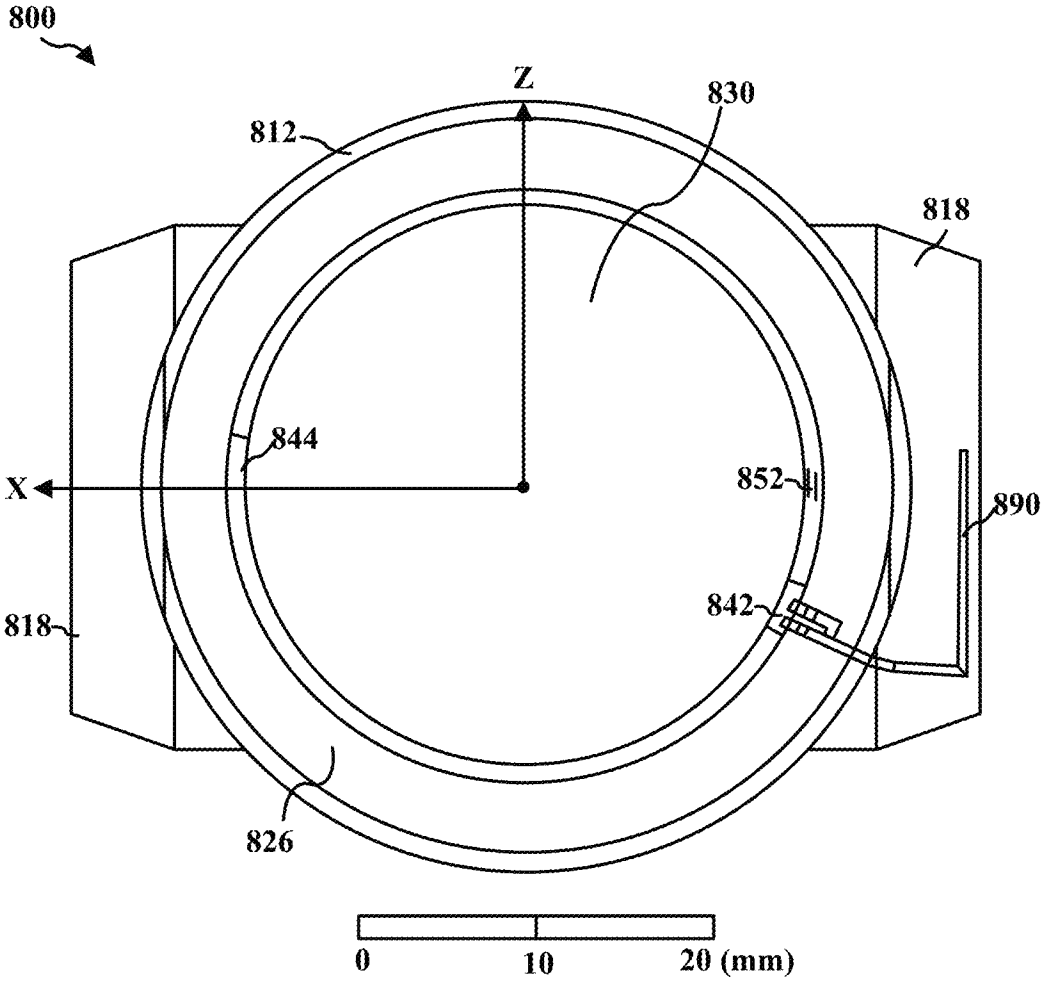
FIGS. 8-12 are diagrams illustrating a wearable communication apparatus 800.

The antenna of the current disclosed technologies may be a slot antenna, which may be formed from a metal ring configuration in an electrically conductive plate. FIG. 7 shows a slot antenna 700 formed from a plate 714 of conductive material, such as metal, having a slot 716 formed therein. When the plate is excited by a driving frequency, the slot 716 radiates electromagnetic waves in a manner similar to a dipole. The shape and size of the slot, as well as the driving frequency, determine the radiation distribution pattern. A slot antenna may be formed as a single planar plate.

The dimensions of the slot 716 may be utilized to form a bezel or ring of a watch housing or part thereof. Thus, by forming a slot antenna that includes the slot 716, the antenna itself may be used as a frame or bezel of a mobile communication device, such as a watch that includes a ring-shaped bezel. In this way, a watch's bezel may serve as both an antenna and a structural element (as well as aesthetic).

Figure 9:
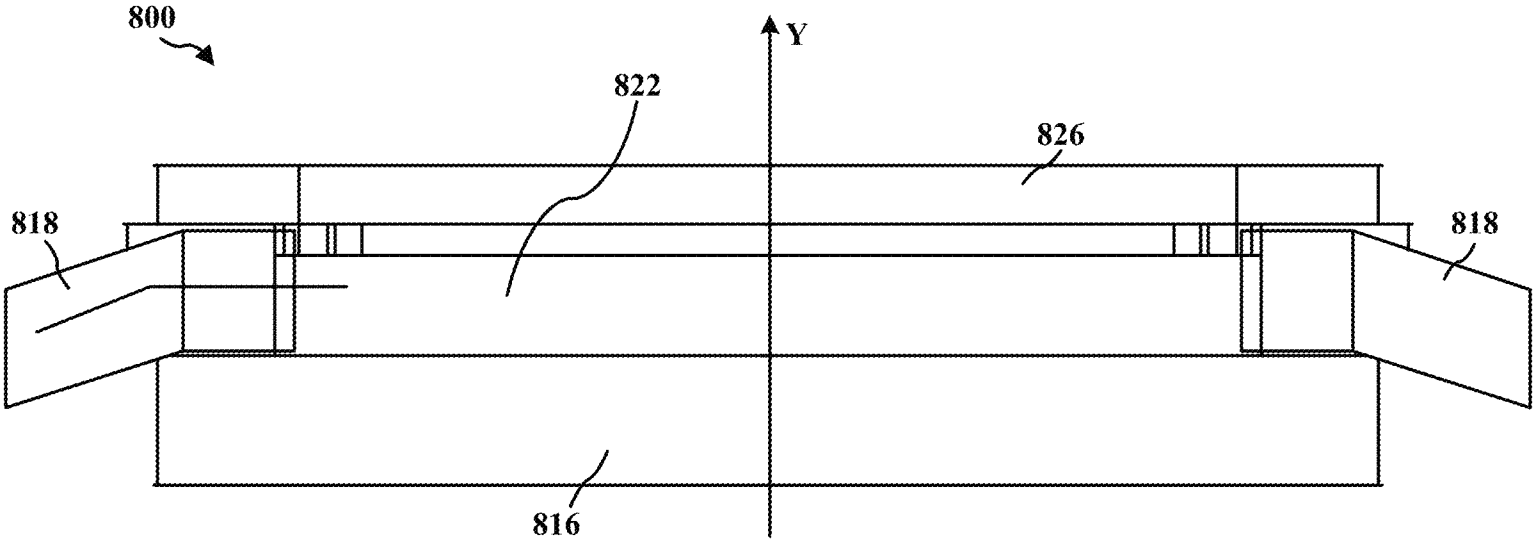
Figure 10:
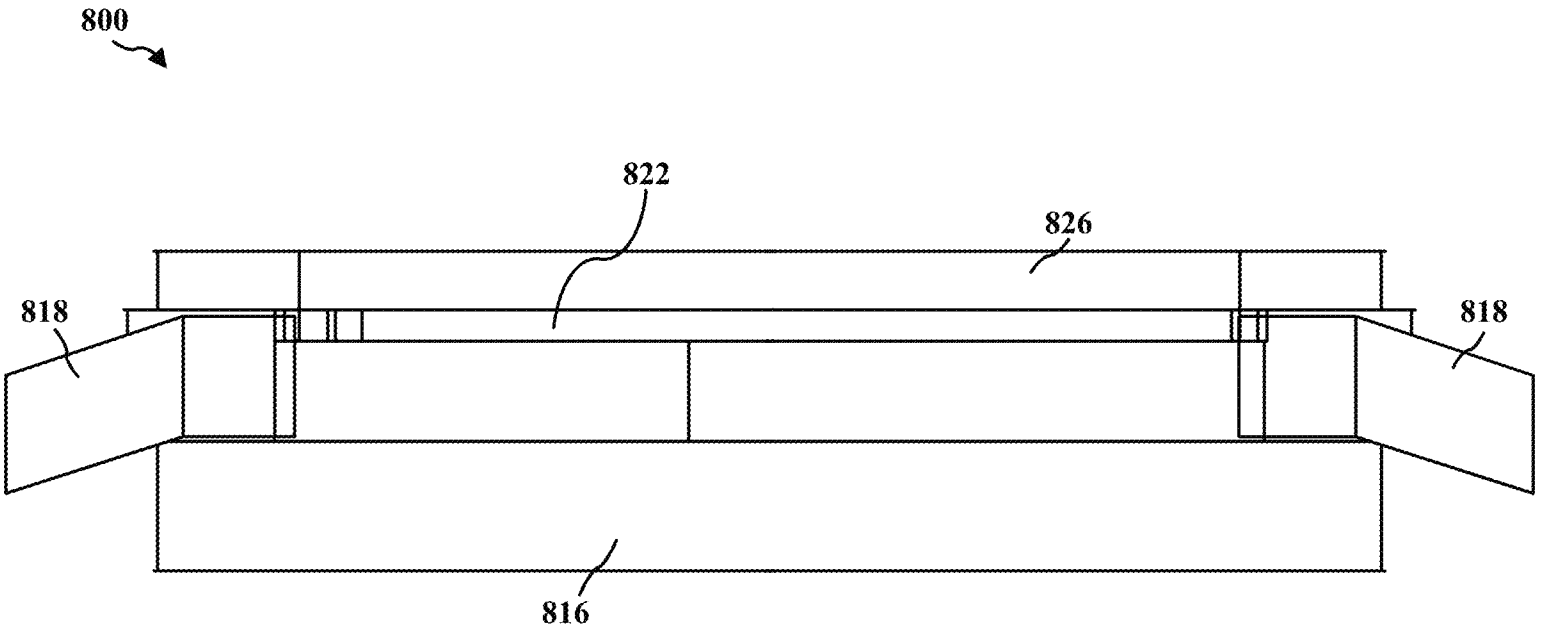

FIGS. 8-12 are diagrams illustrating a wearable communication apparatus 800. The wearable communication apparatus 800 may be the UE 102 and the UE 206. In this example, the wearable communication apparatus 800 is a personal smart watch. The wearable communication apparatus 800 may be other type of devices such as a bracelet or a necklace. The wearable communication apparatus 800 has a housing member 812. The housing member 812 holds a base member 816 and a ring member 822 (FIG. 9). The ring member 822 surrounds a bezel 826. The shape of the bezel 826 may be any shape that is suitable for the wearable communication apparatus 800. For example, the bezel 826 may be round, elliptical, cylindrical, rectangular, etc.

Figure 15:
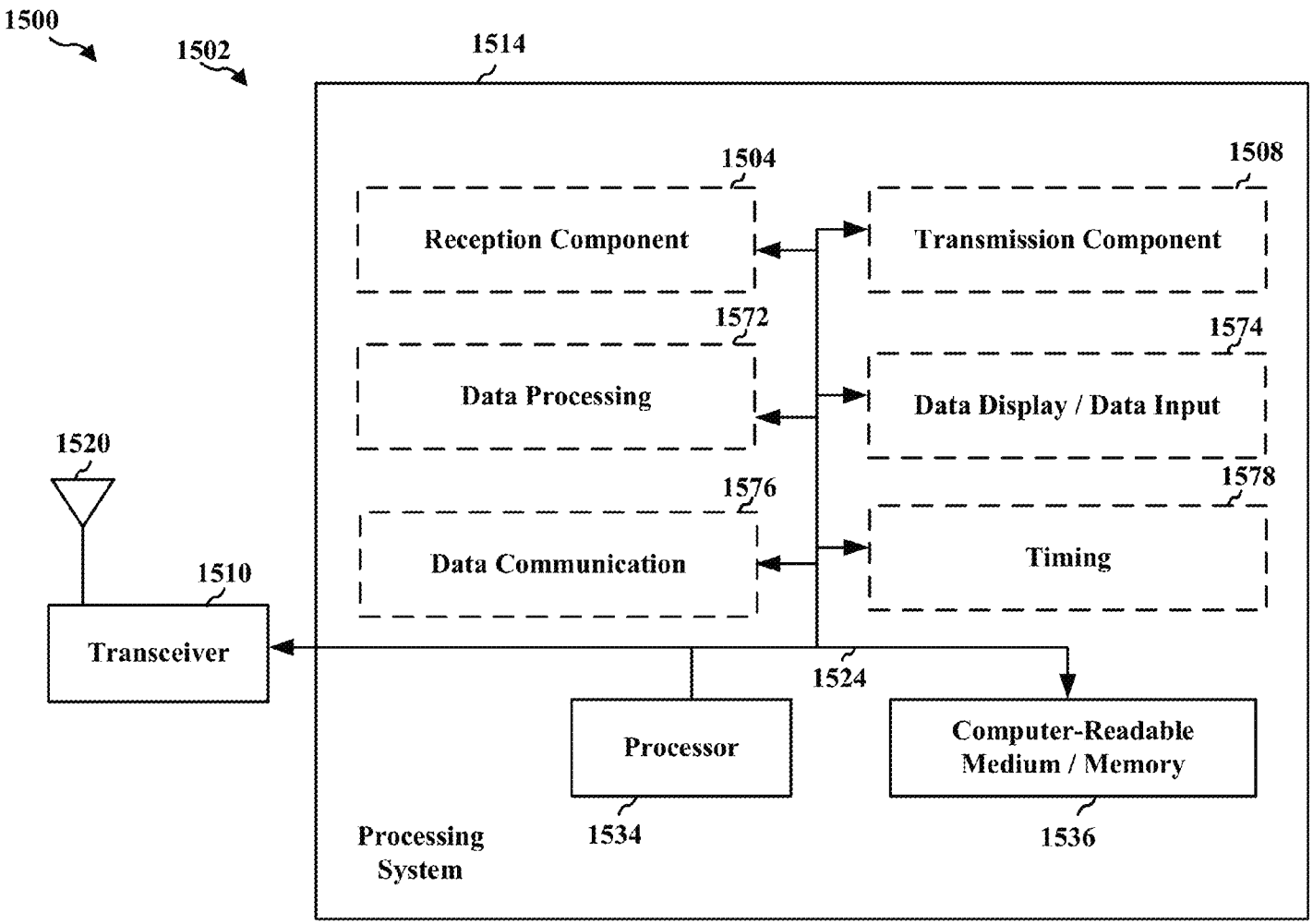
FIG. 15 is a diagram illustrating an example of a hardware implementation for an apparatus employing a processing system.

The bezel 826 may define an opening that corresponds to the slot 716 illustrated in FIG. 7. The bezel 826 may function as a part of a slot antenna. The bezel 826 may hold a panel 830. For example, the panel 830 may be a display panel with touch sensors. The panel 830 may be a part of a functional component such as the data display/data input component 1574 described infra (FIG. 15). The panel 830 and the bezel 826 are spaced apart from the base member 816. A portion of the ring member 822 may be placed in between the bezel 826 and the base member 816 in order to separate the bezel 826 and the base member 816. The panel 830, the bezel 826, the ring member 822, the base member 816, and/or the housing member 812 may define a housing structure 814 (FIG. 11), in which one or more functional components, such as the data processing component 1572, the data display/data input component 1574, the data communication component 1576, and the timing component 1578 described infra (FIG. 15), are placed. Further, a wristband 818 may be attached to the base member 816. Thus, the wearable communication apparatus 800 may be worn by a person.

The bezel 826 and the base member 816 are conducting members. In certain configurations, the bezel 826 and the base member 816 are made of metals. The ring member 822 is a non-conducting member. In certain configurations, the ring member 822 is made of plastic.

The bezel 826 and the base member 816 may be electrically connected with each other via a first grounding element 842 and a second grounding element 844. Each of the first grounding element 842 and the second grounding element 844 may be a part of the bezel 826 or a part of the base member 816. In certain configurations, the bezel 826 is in electrical connection with the base member 816 through the first grounding element 842 and the second grounding element 844. The bezel 826 further is electrically connected with a communication circuitry (e.g., the data communication component 1576 described infra referring to FIG. 15) via a feeding element 852. In certain configurations, the communication circuitry may also be in electrical connection with a wire inverted F antenna (WIFA) 890.

Figure 11:
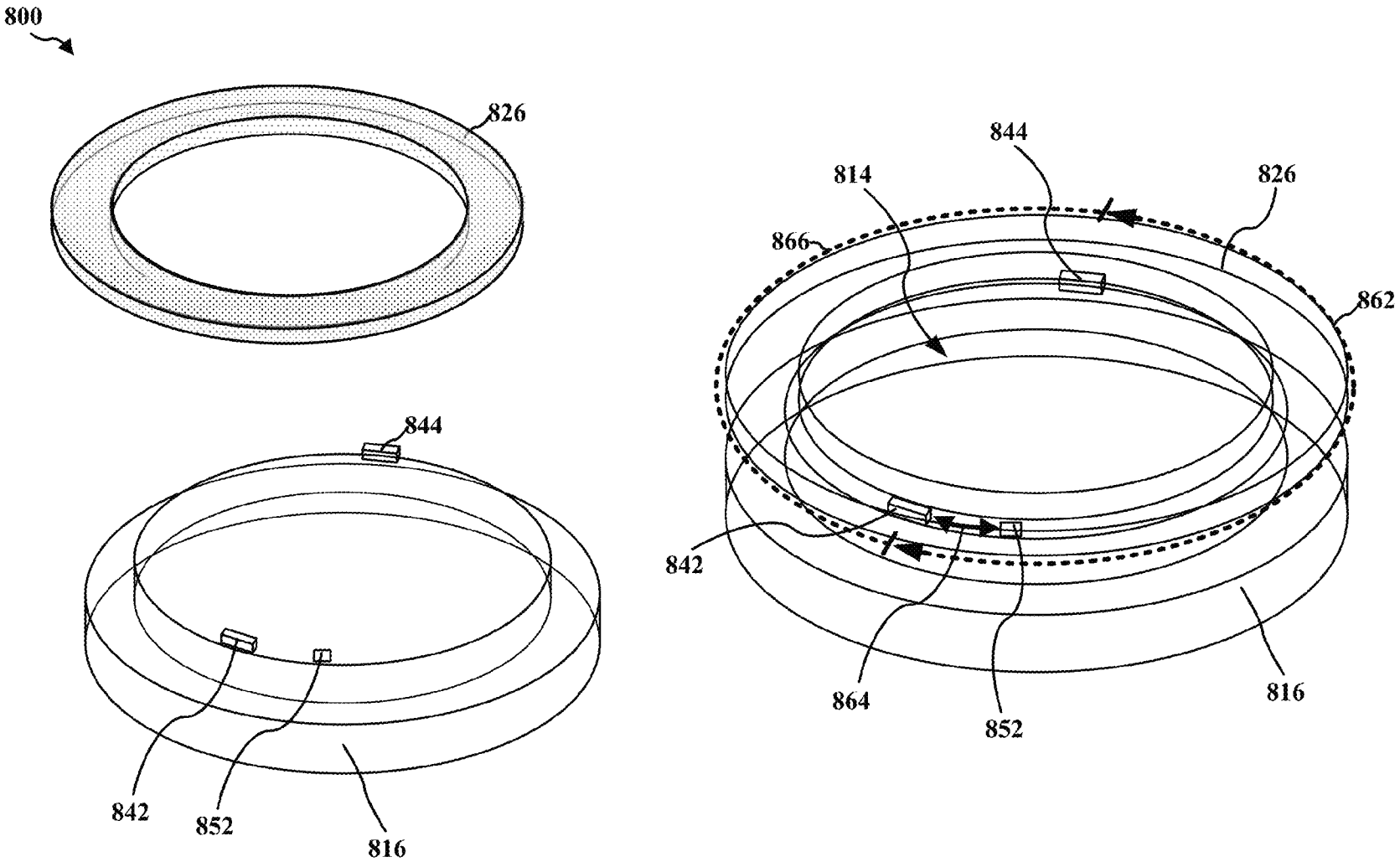
Figure 12:
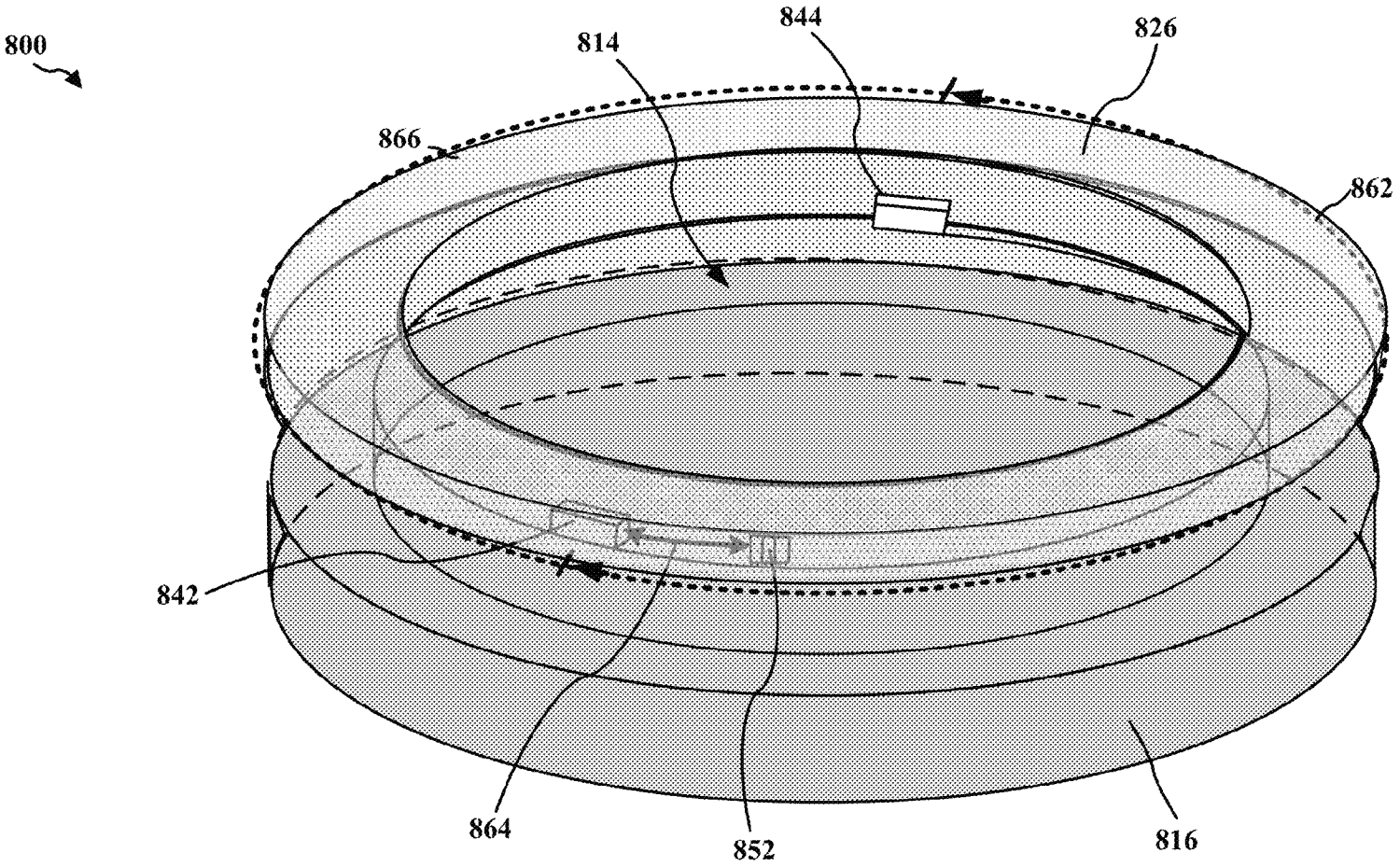

The first grounding element 842 and the second grounding element 844 divide the circumference of the bezel 826 into a feed portion 862 and a non-feed portion 866 (FIGS. 11-12). The feed portion 862 is in electrical connection, and may be in direct contact, with the feeding element 852. In certain configurations, the relative positions of the first grounding element 842 and the second grounding element 844 are adjustable such that the length of the feed portion 862 is accordingly adjustable. Further, in certain configurations, the relative positions of the first grounding element 842 and the feeding element 852 may be also adjustable such that the length of the circumference portion 864, which is within the feed portion 862 and between the first grounding element 842 and the feeding element 852, is also adjustable. The wearable communication apparatus 800 may include an electrical and/or a mechanical mechanism that can adjust the relative positions of the first grounding element 842, the second grounding element 844, and/or the feeding element 852. For example, the bezel 826 may be rotatable with respect to the base member 816, and some of the first grounding element 842, the second grounding element 844, and the feeding element 852 may be attached to the bezel 826. Further, the rest of the first grounding element 842, the second grounding element 844, and the feeding element 852 may be attached to the base member 816. As such, the relative positions of the first grounding element 842, the second grounding element 844, and the feeding element 852 may be adjusted by rotating the bezel 826. Further, the wearable communication apparatus 800 may include an electrical motor that can rotate the bezel 826.

In certain configurations, the communication circuitry (e.g., the data communication component 1576) provides a communication signal (e.g., a feed current or a feed voltage) at a driving frequency (e.g., the operational frequency of the bezel 826) to the bezel 826 through the feeding element 852 in order to utilize the bezel 826 as a resonant slot antenna. The communication signal may be generated in accordance with data to be transmitted to another device (e.g., the eNB 106, the eNB 204). As such, the communication signal drives a current to flow in the bezel 826 to radiate, over the air, electromagnetic waves that can be captured by the receiving device to obtain the communication signal being transmitted. For example, the communication signal may be generated in accordance with a communication standard or protocol (e.g., LTE) at selected frequencies.

In certain configurations, the bezel 826 may capture, over the air, the electromagnetic waves at selected frequencies. The electromagnetic waves may cause a communication signal (e.g., a current) to flow in the bezel 826. The communication signal may flow to the communication circuitry (e.g., the data communication component 1576) through the feeding element 852.

More specifically, the first grounding element 842 and the second grounding element 844 may be adjusted to control the percentage of the circumference (i.e., the length of the feed portion 862) of the bezel 826 used as an antenna body. The length of the feed portion 862 may be adjusted to be approximately a half wavelength of the operational frequency to be utilized to transmit and to receive communication signals (e.g., in accordance with a communication standard). Particularly, as an example, the first grounding element 842 and the second grounding element 844 may be positioned to enable the bezel 826 to operate at a frequency between 1710 MHz to 2170 MHz, between 2000 MHz to 3000 MHz, or between 700 MHz to 3800 MHz, etc.

The first grounding element 842 and the second grounding element 844 direct the current flowing in the bezel 826 to the base member 816, which functions as ground. Thus, the current provided by the feed current or the feed voltage mainly flows in the feed portion 862. For example, 80%, 85%, 90%, 95%, or 98% of the current may flow in the feed portion 862, but not in the non-feed portion 866. In certain configurations, all of the current provided by the communication signals flows in the feed portion 862. On the other hand, the non-feed portion 866 may be "shorted out" by the first grounding element 842 and the second grounding element 844. That is, none or little of the current flows in the non-feed portion 866. In addition, the circumference portion 864 may be adjusted to control the impedance of the bezel 826 (i.e., the antenna impedance).

As one specific example, the circumference of the bezel 826 may be 116 mm. The length of feed portion 862 may be 61 mm, which is approximately one half of the wavelength at 1900 MHz. The length of the circumference portion 864 is approximately 6 mm, which provides feed point impedance approximately 50 Ohms. As such, the bezel 826 and the base member 816, among other things, may be configured and adapted to function as a single band antenna.

Figure 13:
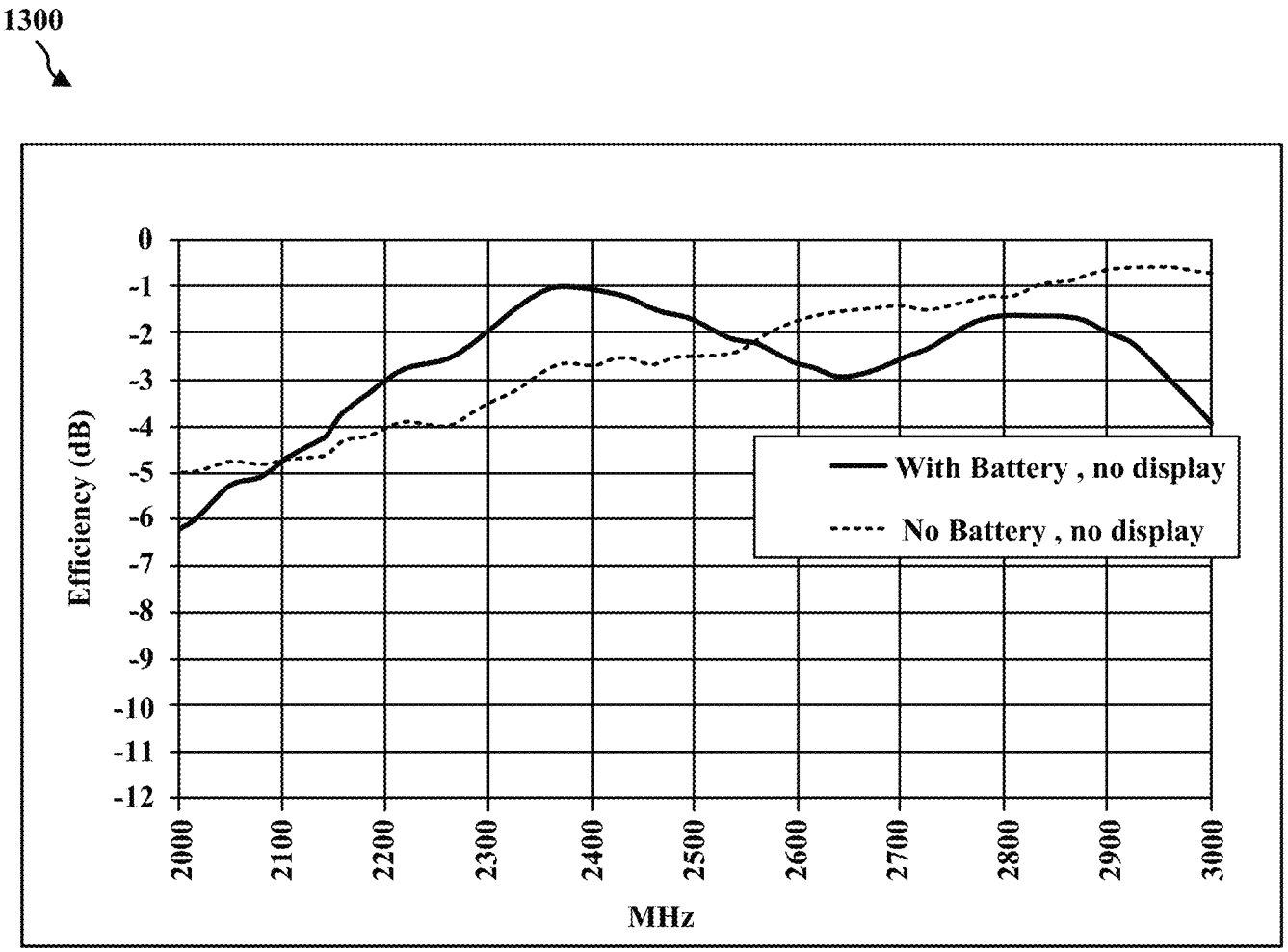
FIG. 13 is a diagram illustrating antenna efficiency.

FIG. 13 is a diagram 1300 illustrating antenna efficiency of the wearable communication apparatus 800 at different frequencies with different configurations. As shown, the first grounding element 842 and the second grounding element 844 are adjusted to provide an operational frequency of the antenna at 2000 MHz to 3000 MHz. Antenna efficiency is shown for two configurations: (a) with battery and without display and (b) without display and without battery.

Figure 14:
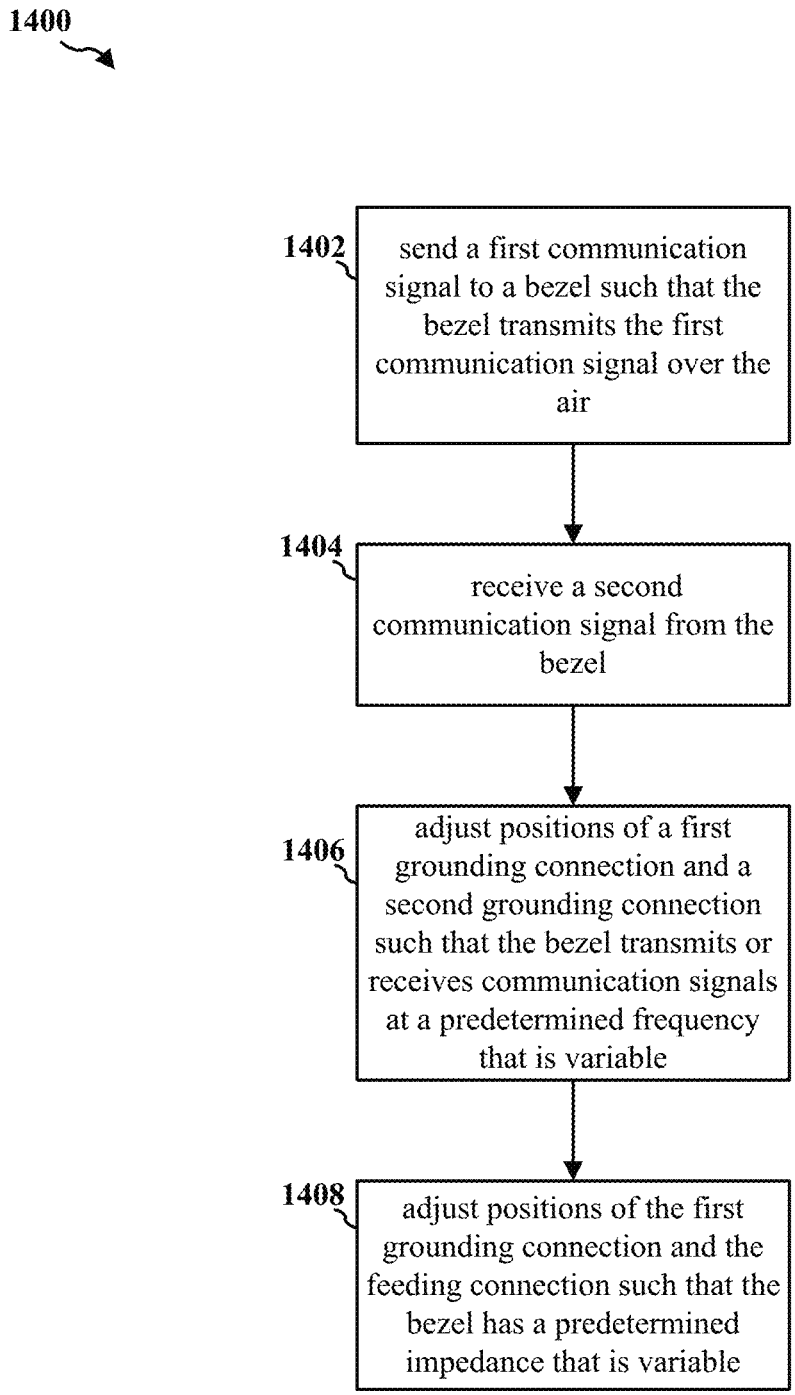
FIG. 14 is a flow chart of a method (process) for operating a bezel of a wearable communication apparatus as a slot antenna.

FIG. 14 is a flow chart 1400 of a method (process) for operating a bezel of a wearable communication apparatus as a slot antenna. The method may be performed by the wearable communication apparatus (e.g., the UE 102, the UE 206, wearable communication apparatus 800, the apparatus 1502).

At operation 1402, the wearable communication apparatus sends a first communication signal to a bezel such that the bezel transmits the first communication signal over the air. The bezel is configured to function as a part of a slot antenna. For example, referring to FIG. 6, the bezel 826 may be a component of the antenna 652. The controller/processor 659, the TX processor 668, and the transmitter 618TX may be operated to send a communication signal to the bezel 826 such that the bezel 826 transmits the communication signal over the air.

At operation 1404, the wearable communication apparatus receives a second communication signal from the bezel. The bezel is further configured to receive the second communication signal over the air. The bezel and a base form at least a part of a housing structure. The bezel and the base are conductive. For example, referring to FIG. 6, the receiver 618RX, the RX processor 656, and the controller/processor 659 may be operated to receive a communication signal from the bezel 826. The bezel 826 received the communication signal over the air.

In certain configurations, the base is electrically connected to the bezel at a first grounding connection and a second grounding connection of the bezel. The bezel is electrically connected to a communication circuitry at a feeding connection. For example, referring to FIG. 11, the bezel 826 is electrically connected the first grounding element 842, the second grounding element 844, and the feeding element 852.

In certain configurations, the wearable communication apparatus, at operation 1406, allows adjusting positions of the first grounding connection and the second grounding connection such that the bezel transmits or receives communication signals at a predetermined frequency that is variable. In certain configurations, the predetermined frequency is within a range of 1710 MHz to 2170 MHz. In certain configurations, the wearable communication apparatus, at operation 1408, allows adjusting positions of the first grounding connection and the feeding connection such that the bezel has predetermined impedance that is variable. For example, referring to FIG. 11, the wearable communication apparatus 800 may include an electrical and/or a mechanical mechanism that can adjust the relative positions of the first grounding element 842, the second grounding element 844, and/or the feeding element 852.

FIG. 15 is a diagram 1500 illustrating an example of a hardware implementation for an apparatus 1502 (i.e., the wearable communication apparatus 800) employing a processing system 1514. The processing system 1514 may be implemented with a bus architecture, represented generally by the bus 1524. The bus 1524 may include any number of interconnecting buses and bridges depending on the specific application of the processing system 1514 and the overall design constraints. The bus 1524 links together various circuits including one or more processors and/or hardware components, represented by the processor 1534, a data processing component 1572, a data display/data input component 1574, a data communication component 1576, a timing component 1578, and the computer-readable medium/memory 1536. The bus 1524 may also link various other circuits such as timing sources, peripherals, voltage regulators, and power management circuits, which are well known in the art, and therefore, will not be described any further.

The processing system 1514 may be coupled to a transceiver 1510. The transceiver 1510 is coupled to one or more antennas 1520 (e.g., the bezel 826 and the WIFA 890). Particularly, the transceiver 1510 may be in electrical connection with the bezel 826 through the feeding element 852. The transceiver 1510 provides a means for communicating with various other apparatus over a transmission medium. The transceiver 1510 receives a signal from the one or more antennas 1520, extracts information from the received signal, and provides the extracted information to the processing system 1514, specifically a reception component 1504. In addition, the transceiver 1510 receives information from the processing system 1514, specifically a transmission component 1508, and based on the received information, generates a signal (e.g., the feed current or the feed voltage) to be applied to the one or more antennas 1520.

The data processing component 1572 may process data (e.g., a webpage) received from another device (e.g., a content server on the Internet) and may instruct the data display/data input component 1574 to display the data to a user of the apparatus 1502 (i.e., the wearable communication apparatus 800). The data processing component 1572 may also generates data in accordance with user inputs received via the data display/data input component 1574.

The data communication component 1576 may have means implementing one or more communication protocols (e.g., MAC and IP), and may construct and process data packets/frames in accordance with the one or more communication protocols. For example, the data communication component 1576 may receive data to be transmitted to a destination and the destination information from the data processing component 1572, and may accordingly generate data packets/frames. Then the data communication component 1576 sends the data packets/frames, via the transmission component 1508, to the transceiver 1510, which may accordingly transmit corresponding communication signals to the bezel 826 in order to transmit, over the air, the communication signals to a receiving device in compliance with a communication standard (e.g., LTE). On the other hand, the bezel 826 may receive communication signals over the air and accordingly may provide the communication signals to the transceiver 1510, which then sends, utilizing the reception component 1504, the data packets/frames carried by the received communication signals to the data communication component 1576. The data communication component 1576 then extracts the data (e.g., a webpage) from the data packets/frames and sends the data to the data processing component 1572 for processing. The data processing component 1572 may instruct the data display/data input component 1574 to display the data (e.g., the webpage).

Further, the timing component 1578 may provide timing information such as current time to the data display/data input component 1574 for display.

The processing system 1514 includes a processor 1534 coupled to a computer-readable medium/memory 1536. The processor 1534 is responsible for general processing, including the execution of software stored on the computer-readable medium/memory 1536. The software, when executed by the processor 1534, causes the processing system 1514 to perform the various functions described supra for any particular apparatus. The computer-readable medium/memory 1536 may also be used for storing data that is manipulated by the processor 1534 when executing software. The processing system further includes at least one of the components 1504, 1508, 1572, 1574, 1576, 1578. The components may be software components running in the processor 1534, resident/stored in the computer-readable medium/memory 1536, one or more hardware components coupled to the processor 1534, or some combination thereof. The processing system 1514 may be a component of the UE 650 (e.g., the wearable communication apparatus 800) and may include the memory 660 and/or at least one of the TX processor 668, the RX processor 656, and the controller/processor 659.

The apparatus 1502 may include additional components or means that perform other functionalities (e.g., gaming). The components may be one or more hardware components specifically configured to carry out the stated processes/algorithm, implemented by a processor configured to perform the stated processes/algorithm, stored within a computer-readable medium for implementation by a processor, or some combination thereof.

In one configuration, the apparatus 1502 for wireless communication includes means for operations illustrated in FIG. 14. The aforementioned means may be one or more of the aforementioned components of the processing system 1514 of the apparatus 1502 configured to perform the functions recited by the aforementioned means.

In certain configurations, the apparatus 1502 may be configured to include means for sending a first communication signal to a bezel such that the bezel transmits the first communication signal over the air. The bezel is configured to function as a slot antenna. The apparatus 1502 may be configured to include means for receiving a second communication signal from the bezel. The bezel is further configured to receive the second communication signal over the air. The bezel and a base form at least a part of a housing structure. The bezel and the base are conductive. In certain configurations, the base is electrically connected to the bezel at a first grounding connection and a second grounding connection of the bezel. The bezel is electrically connected to the means for sending and the means for receiving at a feeding connection.

In certain configurations, the apparatus 1502 may be configured to include means for adjusting positions of the first grounding connection and the second grounding connection such that the bezel transmits or receives communication signals at a predetermined frequency that is variable. In certain configurations, the predetermined frequency is within a range of 1710 MHz to 2170 MHz. In certain configurations, the apparatus 1502 may be configured to include means for adjusting positions of the first grounding connection and the feeding connection such that the bezel has predetermined impedance that is variable.

As described supra, the processing system 1514 may include the TX Processor 668, the RX Processor 656, and the controller/processor 659. As such, in one configuration, the aforementioned means may be the TX Processor 668, the RX Processor 656, and the controller/processor 659 configured to perform the functions recited by the aforementioned means.

The terms "about" or "approximately" generally mean within 20 percent, preferably within 10 percent, and more preferably within 5 percent of a given value or range. Numerical quantities given herein are approximate, meaning that the term "about" or "approximately" can be inferred if not expressly stated.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A wearable communication apparatus for wireless communication, comprising:

communication circuitry;

a bezel, the bezel being conductive; and a base, the base being conductive, wherein the bezel and the base form at least a part of a housing structure supporting the communication circuitry, wherein the base is electrically connected to the bezel at a first grounding connection and a second grounding connection of the bezel such that positions of the first grounding connection and the second grounding connection are adjustable such that the bezel transmits or receives communication signals at a predetermined frequency that is variable, wherein the communication circuitry is electrically connected to the bezel, wherein the bezel is configured to function as a part of a slot antenna, wherein the communication circuitry is configured to send a first communication signal to the bezel such that the bezel transmits the first communication signal over the air, and wherein the bezel is further configured to receive, over the air, a second communication signal and direct the second communication signal to the communication circuitry.

2. The wearable communication apparatus of claim 1, wherein the communication circuitry is electrically connected to the bezel at a feeding connection.

3. The wearable communication apparatus of claim 2, wherein the first grounding connection and the second grounding connection are positionable at first positions such that the bezel transmits or receives communication signals at a first predetermined frequency.

4. The wearable communication apparatus of claim 3, wherein the first grounding connection and the second grounding connection are positionable at second positions such that the bezel transmits or receives communication signals at a second predetermined frequency.

5. The wearable communication apparatus of claim 2, wherein the first grounding connection and the feeding connection are positionable at third positions such that impedance of the bezel is at a first predetermined value.

6. The wearable communication apparatus of claim 2, wherein positions of the first grounding connection and the feeding connection are adjustable such that the bezel has predetermined impedance that is variable.

7. The wearable communication apparatus of claim 1, wherein a percentage of a circumference of the bezel configured to function as a part of the slot antenna is adjustable.

8. The wearable communication apparatus of claim 1, wherein the predetermined frequency is within a range of 1710 MHz to 2170 MHz.

9. The wearable communication apparatus of claim 1, wherein the bezel and the base are made of metal.

10. The wearable communication apparatus of claim 1, further comprising a non-conducting member, wherein the bezel and the base are spaced apart and the non-conducting member is placed in between the bezel and the base.

11. The wearable communication apparatus of claim 1, wherein the wearable communication apparatus is a watch.

12. The wearable communication apparatus of claim 1, further comprising at least one functional component, wherein the housing structure supports the at least one functional component.

13. The wearable communication apparatus of claim 12, where the at least one functional component performs a timing functionality.

14. The wearable communication apparatus of claim 12, where the at least one functional component performs at least one of a data communication functionality, a data processing functionality, and a data display functionality.

15. A slot antenna for use at a wearable communication apparatus, comprising:

a bezel, the bezel being conductive; and a base, the base being conductive and electrically connected to the bezel at a first grounding connection and a second grounding connection of the bezel such that positions of the first grounding connection and the second grounding connection are adjustable such that the bezel transmits or receives communication signals at a predetermined frequency that is variable, wherein the bezel is electrically connected to a communication circuitry, wherein the bezel is configured to receive a first communication signal from the communication circuitry and transmits the first communication signal over the air, and wherein the bezel is further configured to receive, over the air, a second communication signal and direct the second communication signal to the communication circuitry.

16. The slot antenna of claim 15, wherein the bezel is electrically connected to the communication circuitry at a feeding connection.

17. The slot antenna of claim 16, wherein positions of the first grounding connection and the feeding connection are adjustable such that the bezel has predetermined impedance that is variable.

18. The slot antenna of claim 15, wherein a percentage of a circumference of the bezel configured to function as a part of a slot antenna is adjustable.

19. The slot antenna of claim 15, wherein the predetermined frequency is within a range of 1710 MHz to 2170 MHz.

20. The slot antenna of claim 15, wherein the bezel and the base are made of metal.

21. A method of wireless communication of a wearable communication apparatus, comprising:

sending a first communication signal to a bezel such that the bezel transmits the first communication signal over the air, wherein the bezel is configured to function as a part of a slot antenna;

receiving a second communication signal from the bezel, wherein the bezel is further configured to receive the second communication signal over the air; and adjusting positions of a first grounding connection and a second grounding connection such that the bezel transmits or receives communication signals at a predetermined frequency that is variable, wherein the bezel and a base form at least a part of a housing structure, and wherein the bezel and the base are conductive.

22. The method of claim 21, wherein the base is electrically connected to the bezel at the first grounding connection and the second grounding connection of the bezel, wherein the bezel is electrically connected to a communication circuitry at a feeding connection.

23. The method of claim 22, wherein adjusting the positions of the first grounding connection and the second grounding connection correspond to an adjustment of a percentage of a circumference of the bezel configured to function as a part of the slot antenna.

24. The method of claim 22, further comprising adjusting positions of the first grounding connection and the feeding connection such that the bezel has predetermined impedance that is variable.

25. The method of claim 21, wherein the predetermined frequency is within a range of 1710 MHz to 2170 MHz.

26. A wearable communication apparatus for wireless communication, comprising:

means for sending a first communication signal to a bezel such that the bezel transmits the first communication signal over the air, wherein the bezel is configured to function as a part of a slot antenna;

means for receiving a second communication signal from the bezel, wherein the bezel is further configured to receive the second communication signal over the air; and means for adjusting positions of a first grounding connection and a second grounding connection such that the bezel transmits or receives communication signals at a predetermined frequency that is variable, wherein the bezel and a base form at least a part of a housing structure, and wherein the bezel and the base are conductive.

27. The wearable communication apparatus of claim 26, wherein the base is electrically connected to the bezel at the first grounding connection and the second grounding connection of the bezel, and wherein the bezel is electrically connected to the means for sending and the means for receiving at a feeding connection.

28. The wearable communication apparatus of claim 27, wherein the means for adjusting positions of the first grounding connection and the second grounding connection correspond to an adjustment of a percentage of a circumference of the bezel configured to function as a part of the slot antenna.

29. The wearable communication apparatus of claim 27, further comprising means for adjusting positions of the first grounding connection and the feeding connection such that the bezel has predetermined impedance that is variable.

30. The wearable communication apparatus of claim 26, wherein the predetermined frequency is within a range of 1710 MHz to 2170 MHz.

* * * * *